United States Patent [19]

Passley et al.

[11] 4,168,738

[45] Sep. 25, 1979

[54] CONTINUOUS METAL CASTING

[75] Inventors: Gerald A. Passley, Burton-on-the-Wolds; Terence J. Green, Leicester, both of England

[73] Assignee: John Jones & Son Limited, Leicestershire, England

[21] Appl. No.: 910,742

[22] Filed: May 30, 1978

[30] Foreign Application Priority Data

Jun. 11, 1977 [GB] United Kingdom ..... 24480/77

[51] Int. Cl.[2] ..... B22D 11/128; B22D 11/16

[52] U.S. Cl. ..... 164/82; 164/413; 164/442; 164/440

[58] Field of Search ..... 164/82, 85, 270, 76, 164/418, 421, 422, 439, 440, 87, 88, 427, 441, 442; 249/59, 413

[56] References Cited

U.S. PATENT DOCUMENTS 3,153,821 10/1964 Manasoff ..... 164/270

*Primary Examiner*—Robert D. Baldwin
*Assistant Examiner*—K. Y. Lin
*Attorney, Agent, or Firm*—Buell, Blenko & Ziesenheim

[57] ABSTRACT

Apparatus and method of metal casting utilize a die having at least one helical rib or channel surrounded by a cooler which cooperates with a means for imparting a relative screwing motion, such as a pair of rollers at an angle to the longitudinal member which is being cast, to screw a helically shaped metal member continuously from the die.

8 Claims, 4 Drawing Figures

CONTINUOUS METAL CASTING

FIELD OF INVENTION

The invention relates to apparatus and processes for continuous casting. The invention produces cast articles which may be screws for use for example in feed screws and rotary screw compressors.

SUMMARY OF INVENTION

According to the invention there is firstly provided an apparatus for continuous casting which includes a molten metal receiver, a fixed die having at least one helical rib or channel and surrounded by a cooler and a means for imparting a screwing motion to the partly solidified metal member formed in the die so as to withdraw the member from the die.

Secondly the invention provides a process of continuous casting which includes maintaining molten metal in a receiver, partly solidifying the molten metal in a die having at least one helical rib by cooling the die to give a metal member and withdrawing the metal member from the die whilst imparting a screwing motion to the metal member.

The helix angle of the helical rib and the direction of the screwing motion should be matched so that the solidifed shell of the member moves peripherally in the direction of the helical rib. In this way member can be withdrawn without damaging the die, which is generally of graphite.

The die is advantageously secured to the receiver. The cooler may be cooled with water under pressure and may have an inner wall adhered to the die with varying tolerances. A gap may be provided between the die and the inner wall so as to retard cooling where appropriate. The die may include a mandrel so as to form a hollow member. The mandrel may be the part of the die with the helical rib.

Suitably a centering device is provided downstream of the die so as to hold the longitudinal axis of the member in line with that of the die.

The means for imparting a relative screwing motion are provided externally of the die and may act continuously or with interruptions. The means may include rollers for engaging in the helical groove formed by the helical rib of the die in the member. Advantageously a pair of rollers is used arranged on opposite sides of the member to engage diametrically opposite portions of the member and arranged at the same helix angle. One of the rollers may be driven in response to a control system to withdraw the member at a rate consistent with the rate of metal solidification whereas the other roller is connected so as to press the member against the drive roller. Conveniently the drive roller is adjustably mounted to ensure that it is at the desired helix angle and a limited float capacity is provided for thermal contraction of the member.

The invention may be applied to processes and apparatus where two or more members are formed side by side; and to horizontal and vertical die casting.

DESCRIPTION OF DRAWINGS

The invention is more particularly described with reference to the drawings in which.

DESCRIPTION OF SPECIFIC EMBODIMENTS OF INVENTION

Figure 1:
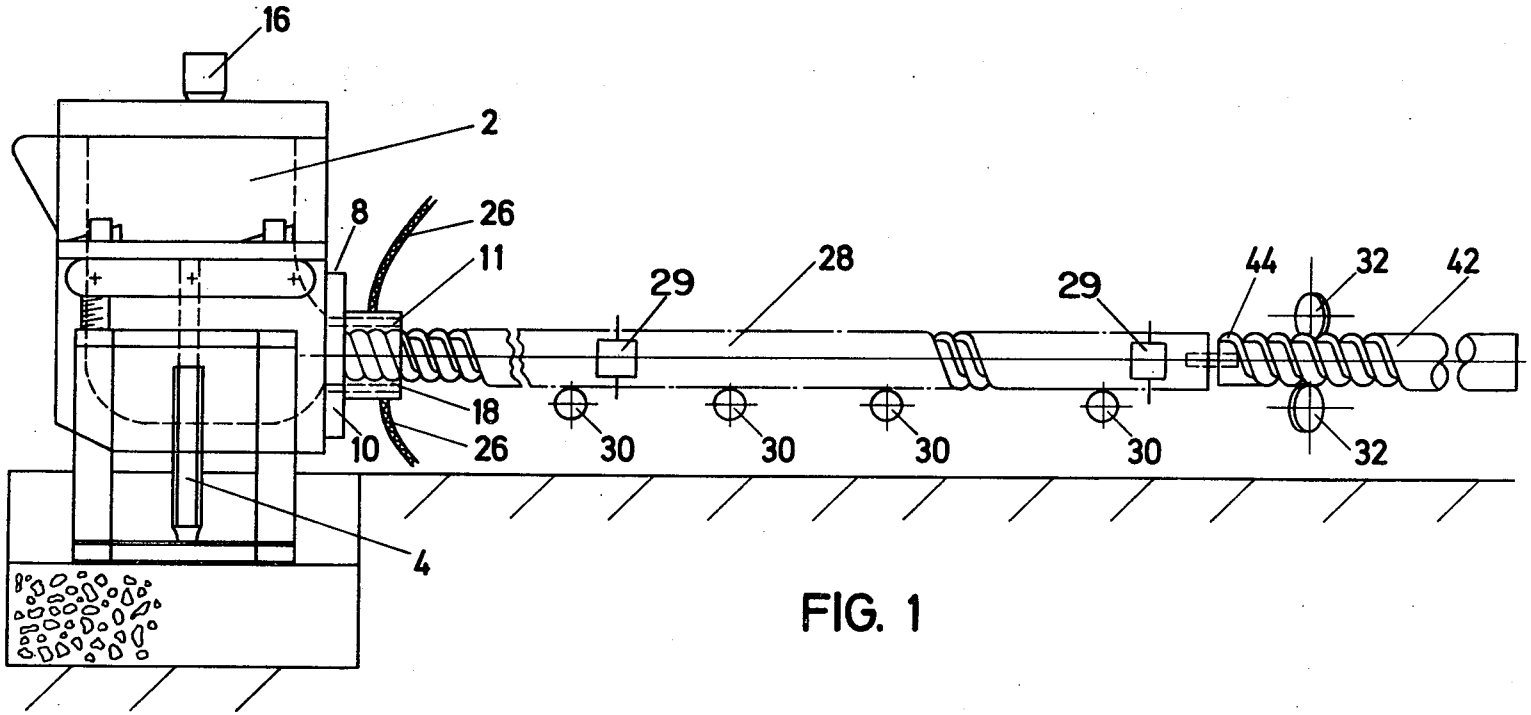
FIG. 1 is a side view of an apparatus of the invention in operation.

With reference to the Figures, a horizontal continuous casting apparatus comprises a receiver 2 for molten metal which is tiltable by a ram 4 for refilling and which has a lid with a slag burner 16. A die assembly 8 has a flange 10 bolted to the receiver 2 and includes a central die 11 of two halves 12 of graphite material which have four helical ribs 14 separating four helical grooves 16. The assembly 8 further includes a cooler 18 having an inner wall 20 adhered to the halves 12 but slightly spaced from the halves in the area of the ribs 16 to retard their cooling; and an outer wall 22 with couplings 24 for the supply and removal of cooling water under pressure through pipes 26.

The continuous casting apparatus further includes appropriate guide means for the member 28 withdrawn from the die 11 including support rollers 30 and, if appropriate side rollers 29 with vertical axes on each side of the member 28 (not shown) to act as a centering means.

Figure 2:
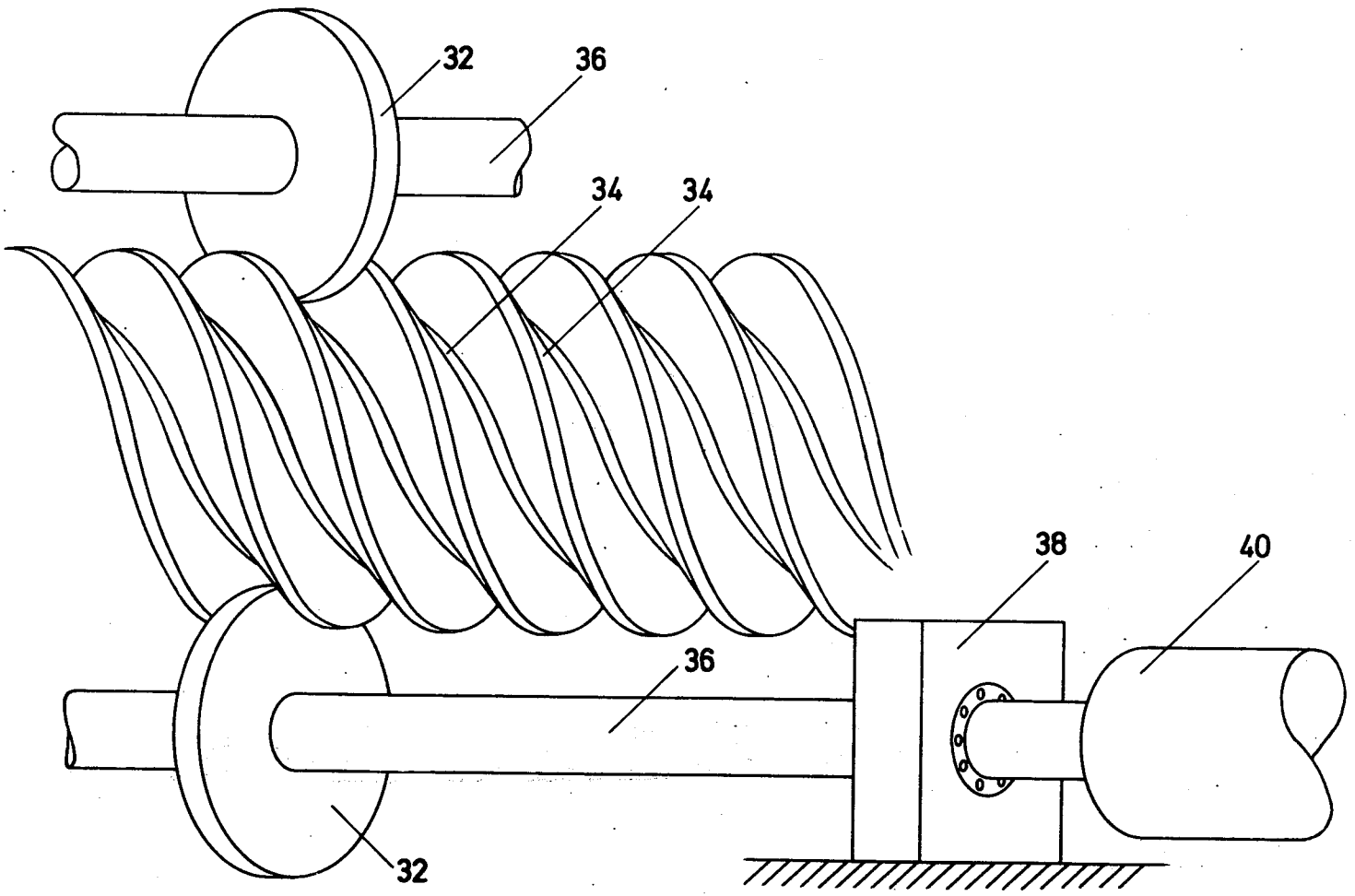
FIG. 2 is an enlarged side view of the motion imparting mechanism of the apparatus of FIG. 1.
Figure 3:
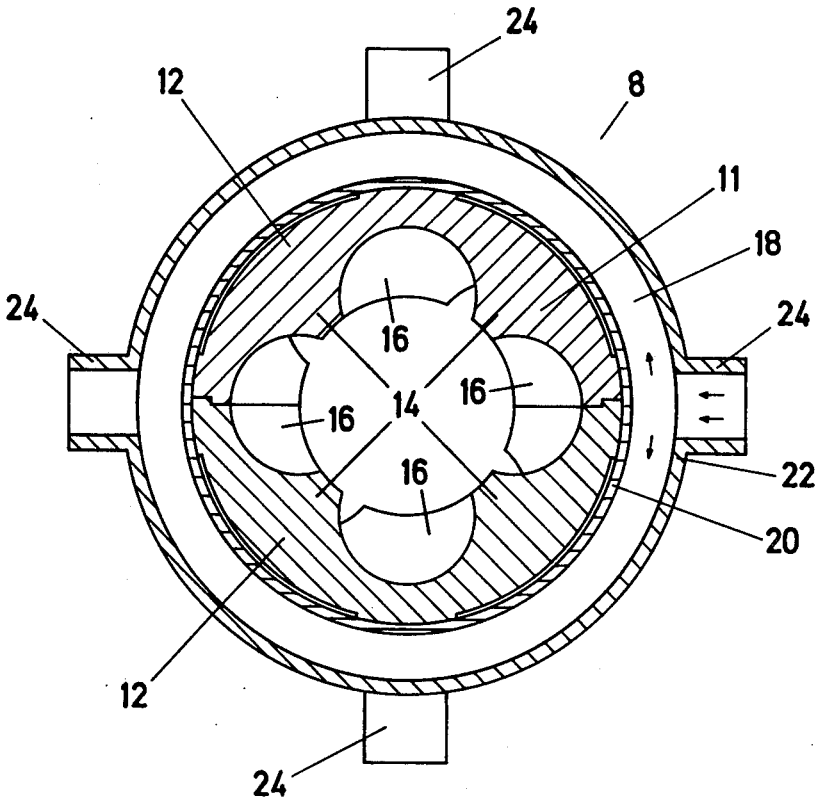
FIG. 3 is an enlarged section through the die of the apparatus of FIG. 1.

The withdrawal mechanism of the apparatus is only schematically shown in FIGS. 1 and 2. A pair of rollers 32 engages in grooves 34 formed in the member 28 by the ribs 14. The rollers 32 are connected by shafts 36 journalled in bearings 38 on their respective support tables. The upper support table is mounted by hydraulic rams to enable it to be urged downward at an appropriate pressure; the lower support table is fixed against vertical movement and the shaft 36 journalled thereon is driven by an electric motor 40 in accordance with control signals. The upper and lower table may be connected to allow the shaft angle to be adjusted accurately and simultaneously in opposite senses whilst keeping the rollers 32 aligned to engage diametrically opposite parts of the member 28. Alternatively the upper table may be freely rotatable to adjust automatically to the helix angle of the member 28 being withdrawn. The upper and lower tables jointly may be slidably supported for lengthwise movement to allow for thermal contraction of the member 28.

The withdrawal mechanism may be followed by a hydraulic break installation for separating the appropriate lengths of the member 28 from the part of the member 28 being withdrawn.

To commence operation a pulling bar 42 is used having an initial helically shaped part 44 conforming to the die 11. This is used to withdraw, with the appropriate screwing motion, the leading part of the continuous cast member.

The angle of the rollers 32 is important and must match that of the helical ribs 14. Provided the grooves in the member 28 have a suitable shape at their bottom, the rollers 32 can be used to withdraw members of different diameters, groove spacings and groove numbers.

The temperature of the molten metal may be circa 1200° C. and the cooling of the die 11 can be adjusted to provide a one inch skin of solidified metal at the die exit to provide suitable transfer of torque to the part of the member still inside the die 11. Cast-iron and copper containing alloys may be used as well as any other alloy which forms a suitable skin. The temperature at the die exit may be 900° C.

Using the invention helically grooved members can be made which do not require excessive milling operations to provide final exterior dimensions. The rollers 32 can be controlled simply and may be adapted to engage in varying sizes of grooves. The members 28 may have any number of helical grooves either wound left hand or right hand and may be hollow and have internal helical grooves. The invention can also be used to produce helically curved bar material.

Figure 4:
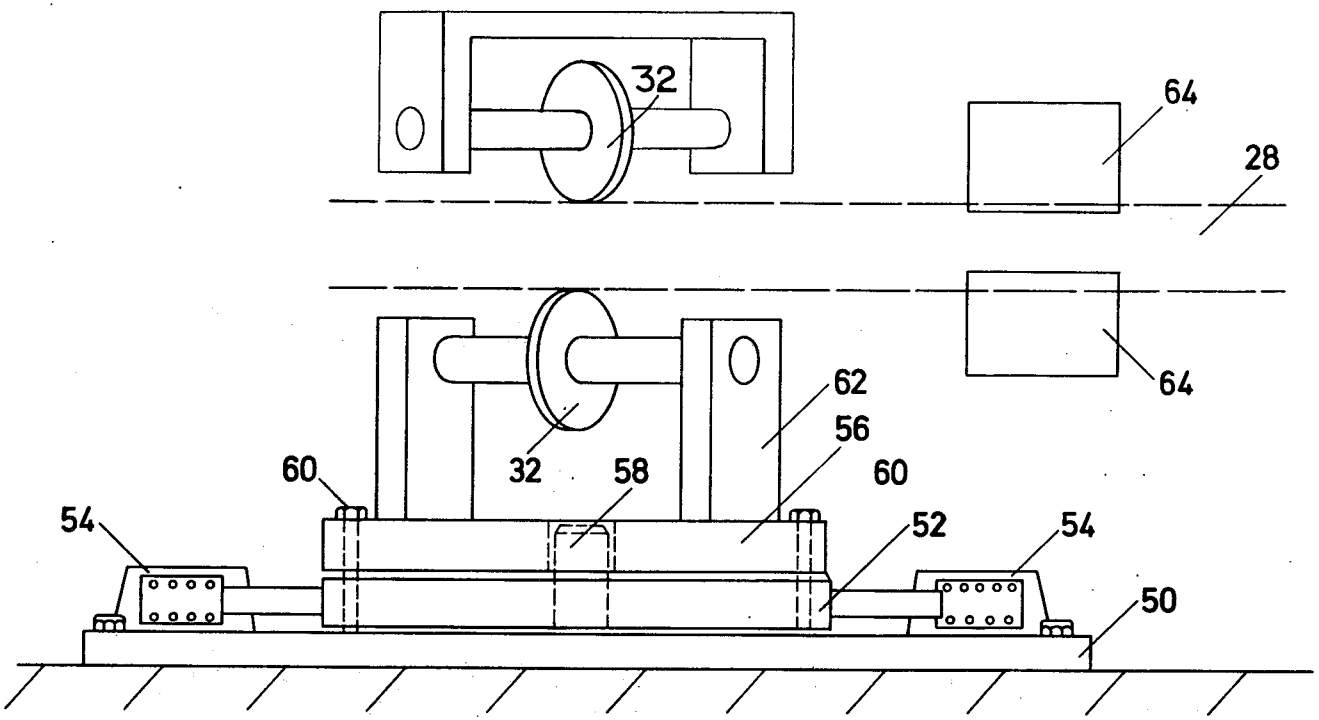
FIG. 4 is a side view enlarged of another motion imparting mechanism for an apparatus according to the invention.

With reference to FIG. 4, the motion imparting mechanism is generally the same as that previously described. A base plate 50 is bolted to the floor and supports an intermediate plate 52 held by sprung rams or shock absorbers 54 against longitudinal movement. The intermediate plate can move between the springs to a limited extent to compensate for thermal contraction. A top plate 56 is mounted centred by a pivot 58 fast to the plate 52 and can be fixed in a number of angles by bolts 60. In this way the roller setting can be adapted to various pitch angles. In FIG. 4 the driven pulling roller 32 is mounted between posts 62 on the top plate 56. To assist the pulling roller 32, rotate and pull jaws 64 are mounted for reciprocal movement towards and away from the member 28. Whilst engaging the member 28, the jaws 64 are driven by cams (not shown) in the appropriate helical direction. Using the jaws traction and grip can be increased.

We claim:

1. Apparatus for continuous casting of skin forming metal at approximately 1200° C. including a stationary molten metal processing assembly having a molten metal receiver, a die defining an elongate orifice internally thereof and having at least one helical rib or channel in the orifice, the orifice communicating with the molten receiver and a cooler surrounding the die externally for causing the molten metal to form a skin on a downstream part of the orifice wall and including a mechanically driven, solidified metal member withdrawing assembly remote from the molten metal processing assembly downstream thereof and having a pair of rollers arranged on opposite sides of an elongate metal member issued from the die to engage diametrically opposed portions of the member and arranged to rotate about an axis at the same angle to the elongate metal member as the angle of the helical rib or channel of the die, at least one of said rollers being driven to withdraw partly solidified metal member from the die whilst rotating it.

2. Apparatus as claimed in claim 9 wherein the cooler has an inlet and an outlet for water under pressure and has an inner wall adhered at locations for increased cooling effect to the die and spaced from the die at other locations for decreased cooling effect to thereby cool the member evenly.

3. Apparatus as claimed in claim 9 wherein a centering means is provided between the die and the withdrawing assembly so as to hold the longitudinal axis of the member in line with that of the die.

4. Apparatus as claimed in claim 9 wherein one of said rollers is driven controllably to withdraw the member at a rate consistent with the rate of metal solidification and skin formation whereas the other roller is connected so as to press the member against the drive roller.

5. Apparatus as claimed in claim 9 wherein means are provided for adjusting the helix angle of the rollers and means are provided for the displacement of the rollers bodily longitudinally of the member to thereby permit its thermal expansion and contraction.

6. Apparatus as claimed in claim 5 wherein one of said rollers is driven in response to a control system to withdraw the member at a rate consistent with the rate of metal solidification whereas the other roller is connected so as to press the member against the drive roller.

7. Apparatus as claimed in claim 5 wherein one of said rollers is driven in response to a control system to withdraw the member at a rate consistent with the rate of metal solidification whereas the other roller is connected so as to press the member against the drive roller and means are provided for adjusting the helix angle of the drive roller and means are provided for the displacement of the rollers bodily longitudinally of the member to thereby permit its thermal expansion and contraction.

8. Process of continuous casting of skin-forming metals which includes the steps of maintaining molten metal in a receiver, delivering said molten metal to a die having at least one internal helical rib, partly solidifying said metal in said die to form an external solidified shell by cooling the die to provide a metal member having an external helical rib and withdrawing the metal member from the die whilst imparting a relative screwing motion between the die and the metal member by rotating said member about its axis, the helix angle of the helical rib and the direction of the screwing motion being matched so that the solidified shell of the member moves peripherally in the direction of the helical rib.

* * * * *

UNITED STATES PATENT AND TRADEMARK OFFICE

CERTIFICATE OF CORRECTION

PATENT NO. : 4,168,738

DATED : September 25, 1979

INVENTOR(S) : GERALD A. PASSLEY and TERENCE J. GREEN

It is certified that error appears in the above-identified patent and that said Letters Patent are hereby corrected as shown below:

In the Drawings, Sheet 1 of 4 (Figure 1), the reference numeral "16" should read --15--.

Column 2, line 14, the reference numeral "16" should read --15--.

Column 2, line 20, the reference numeral "16" should read --14--.

Column 4, Claim 2, line 3, "9" should read --1--.

Column 4, Claim 3, line 9, "9" should read --1--.

Column 4, Claim 4, line 13, "9" should read --1--.

Column 4, Claim 5, line 19, "9" should read --1--.

Signed and Sealed this

*Eighth* Day of *January 1980*

[SEAL]

*Attest:*

SIDNEY A. DIAMOND

*Attesting Officer*

*Commissioner of Patents and Trademarks*